US007491135B1

(12) United States Patent
Rollinson

(10) Patent No.: US 7,491,135 B1
(45) Date of Patent: Feb. 17, 2009

(54) DUAL FACE PUTTER HEAD

(75) Inventor: Augustin W. Rollinson, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 343 days.

(21) Appl. No.: 11/275,363

(22) Filed: Dec. 28, 2005

Related U.S. Application Data

(60) Provisional application No. 60/640,705, filed on Dec. 30, 2004.

(51) Int. Cl.
*A63B 53/00* (2006.01)

(52) U.S. Cl. ..... 473/342

(58) Field of Classification Search ..... 473/342, 473/325

See application file for complete search history.

(56) References Cited

U.S. PATENT DOCUMENTS 4,659,083 A 4/1987 Szczepanski
4,688,798 A 8/1987 Pelz
4,793,616 A 12/1988 Fernandez
5,458,332 A 10/1995 Fisher
5,460,377 A 10/1995 Schmidt et al.
5,464,218 A 11/1995 Schmidt et al.
5,470,068 A 11/1995 Schmidt et al.
5,485,997 A 1/1996 Schmidt et al.
5,575,472 A 11/1996 Magerman et al.
5,674,132 A 10/1997 Fisher
5,921,871 A 7/1999 Fisher
5,951,412 A 9/1999 Rose et al.
6,086,484 A 7/2000 Uebelhor
6,227,986 B1 5/2001 Fisher
6,695,708 B2 2/2004 Fisher
7,341,527 B1 * 3/2008 Fisher ..... 473/329

* cited by examiner

*Primary Examiner*—Raeann Trimiew
(74) *Attorney, Agent, or Firm*—Michael A. Catania; Elaine H. Lo

(57) ABSTRACT

A putter-type club head having a blade member and a peripheral mass belt is disclosed herein. The blade member is preferably composed of an aluminum alloy, and has a first surface with a first insert and a second surface with a second insert. The blade member is removably attached to the peripheral mass belt to allow for a reversal of the striking surface from the first face surface to the second face surface.

19 Claims, 7 Drawing Sheets

DUAL FACE PUTTER HEAD

CROSS REFERENCES TO RELATED APPLICATIONS

The Present Application claims priority to U.S. Provisional Patent Application No. 60/640,705, filed on Dec. 30, 2004.

STATEMENT REGARDING FEDERALLY SPONSORED RESEARCH OR DEVELOPMENT

Not Applicable

BACKGROUND OF THE INVENTION

1. Field of the Invention

The present invention relates to a putter-type club head. More specifically, the present invention relates to a dual face putter-type club head.

2. Description of the Related Art

The golf industry has been inventing putters that make the game of golf easier for the high handicap player. One such putter is disclosed in U.S. Pat. No. 4,688,798 to David Pelz. The Pelz patent discloses a putter with an alignment means to assist a golfer in aiming a golf ball toward a hole during putting. The Pelz patent discloses using two or three golf ball shaped indicators as the alignment means. The golf ball shaped indicators may be circles, hemispheres, or complete spheres. The Pelz patent discloses positioning the indicators along a line extending rearward from the center of percussion.

Another patent that discloses an alignment means is U.S. Pat. No. 4,659,083 to Szczepanski. The Szczepanski patent discloses a group of lines that converge toward the center of the face of the putter.

Yet another patent that discloses an alignment means is Great Britain Patent Application Number 4,659,083 to Lilley. The Lilley patent also discloses a group of lines that converge toward the center of the face of a putter.

Another example is Schmidt et al., U.S. Pat. No. 5,470,068, for a Golf Putter With Dished Bottom Surfaces which discloses a putter composed of a single cast material and having a hollow interior.

Another example is Uebelhor, U.S. Pat. No. 6,086,484, which was filed on Mar. 20, 1998 for a Golf Putter Head. Uebelhor discloses a putter head with a U-shaped body and a block within the middle. The block has a lower specific gravity than the U-shaped body.

Yet another example is Rose et al., U.S. Pat. No. 5,951,412 originally filed in January of 1996 for a Golf Club, Particularly A Putter. The Rose patent discloses a center portion composed of a light metal material and the heel and toe portions composed of heavier metals. The metals are forged or cast to create the putter head.

Another example is Fernandez, U.S. Pat. No. 4,793,616 for a Golf Club, which was originally filed in 1984, discloses a lightweight composite material molded to a hard, high density material for distribution of mass. Fernandez discloses a composite shell with a high density insert composed of tungsten or some other high density material.

Fisher, U.S. Pat. No. 6,695,708 for a Golf Putter With Polyhedral Head And Rotatably Selectable Traction Control Faces, discloses a putter with two faces of different ball impacting characteristics.

Although these inventions have provided new and improved putters for making the game of golf more enjoyable for high handicap players, the prior art has not optimized a putter by making it easily interchangeable from on striking surface to another while providing greater stability.

BRIEF SUMMARY OF THE INVENTION

The present invention provides such a putter with easily interchangeable faces and greater stability.

One aspect of the present invention is a putter-type club head including a blade member, a peripheral mass belt, a first insert, a second insert, a crown member, a sole member and a dampening member. The blade member has a first face surface and a second face surface. The first face surface has a first recess therein and the second face surface has a second recess therein. The first insert is disposed within the first recess and is composed of a polymer material. The second insert is disposed within the second recess and is composed of a metal material. The peripheral mass belt is removably attached to the blade member. The peripheral mass belt has a central body, a first arm extending therefrom and a second arm extending therefrom. The crown member is disposed above the peripheral mass belt and attached thereto. The sole member is disposed below the peripheral mass belt and attached thereto. The dampening member is disposed between the crown member and the sole member, and is also disposed within the first arm and the second arm of the peripheral mass belt.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
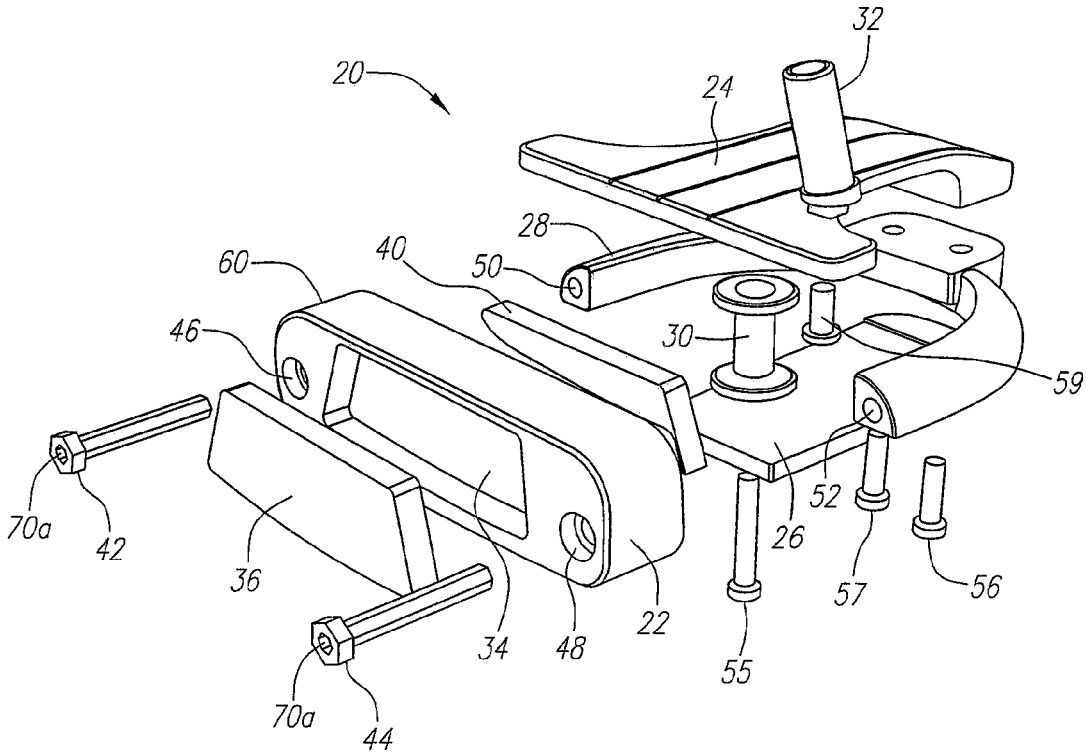
FIG. 1 is an exploded view of a preferred embodiment of a putter-type club head of the present invention.
Figure 2:
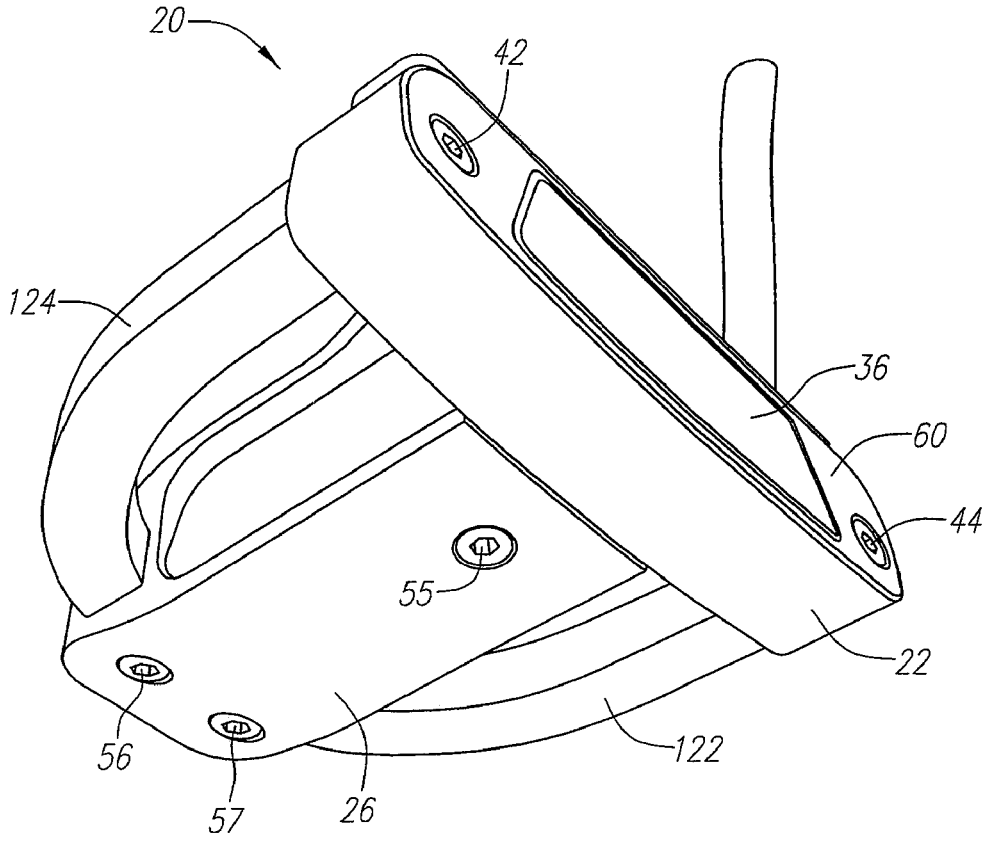
FIG. 2 is a bottom perspective view of a putter-type club head.
Figure 3:
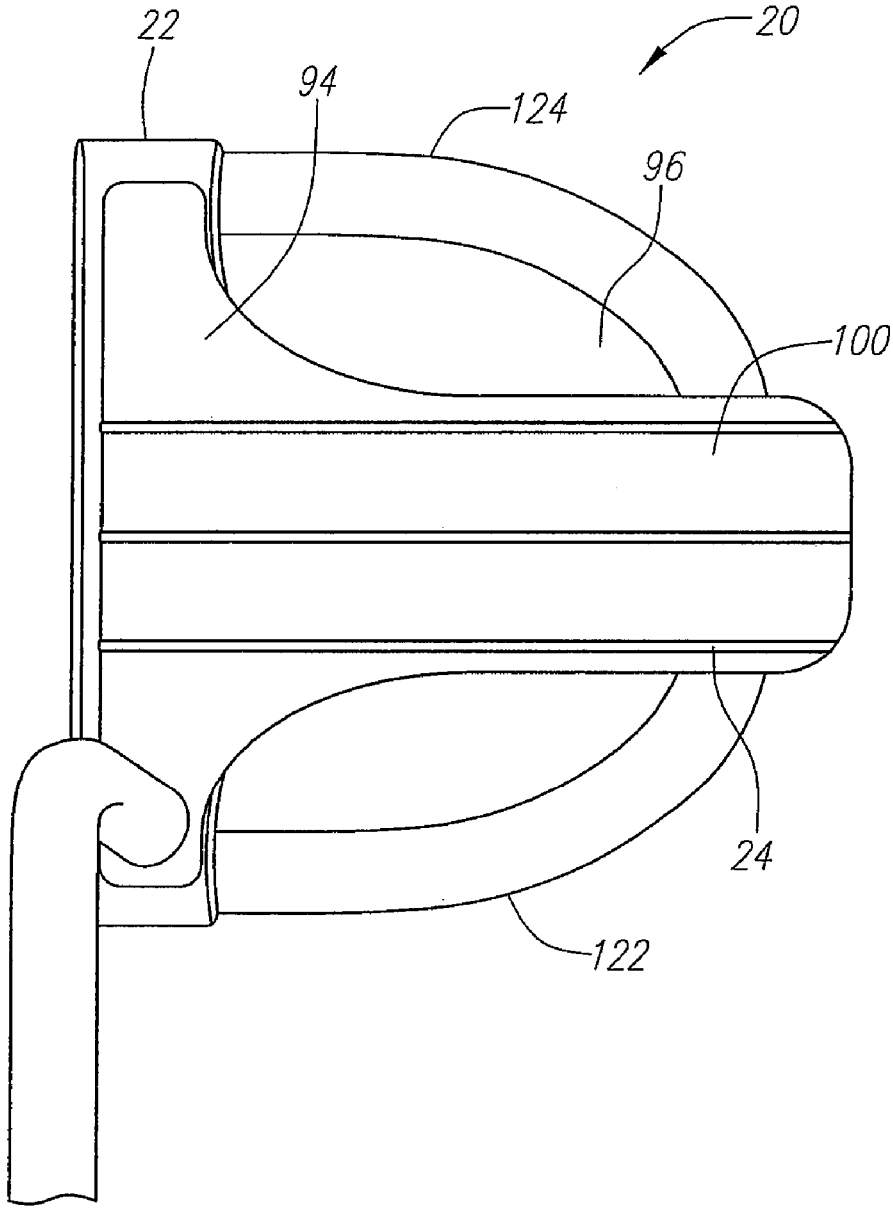
FIG. 3 is a top plan view of putter-type club head.
Figure 4:
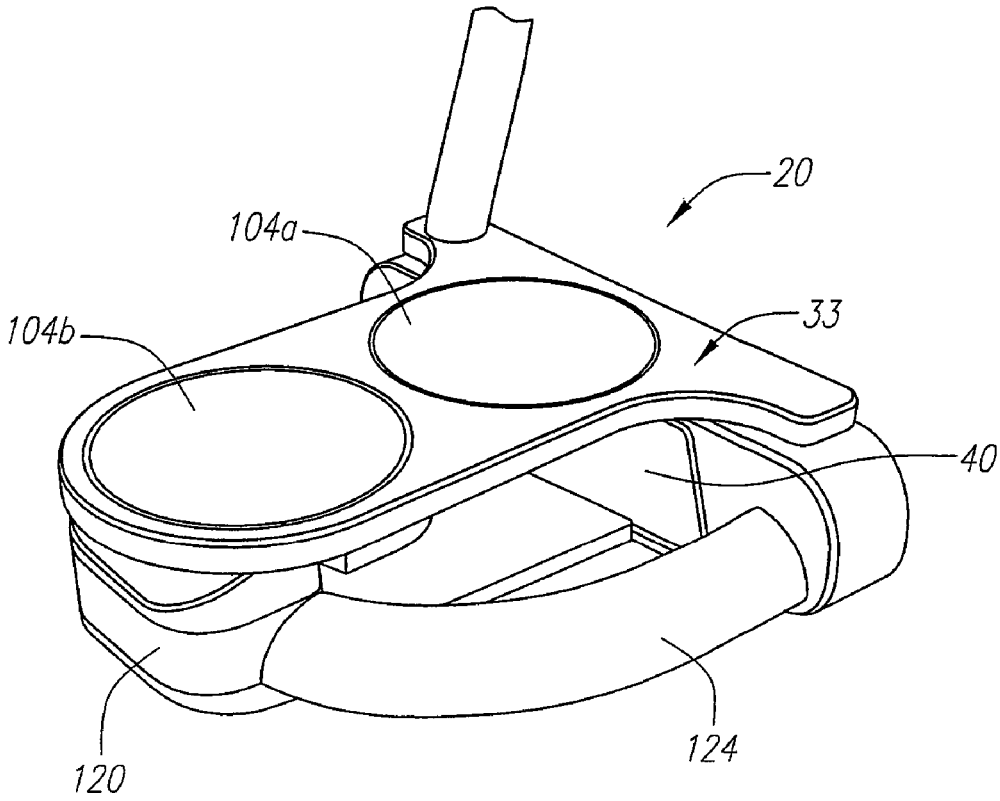
FIG. 4 is a top rear perspective view of a putter-type club head.
Figure 5:
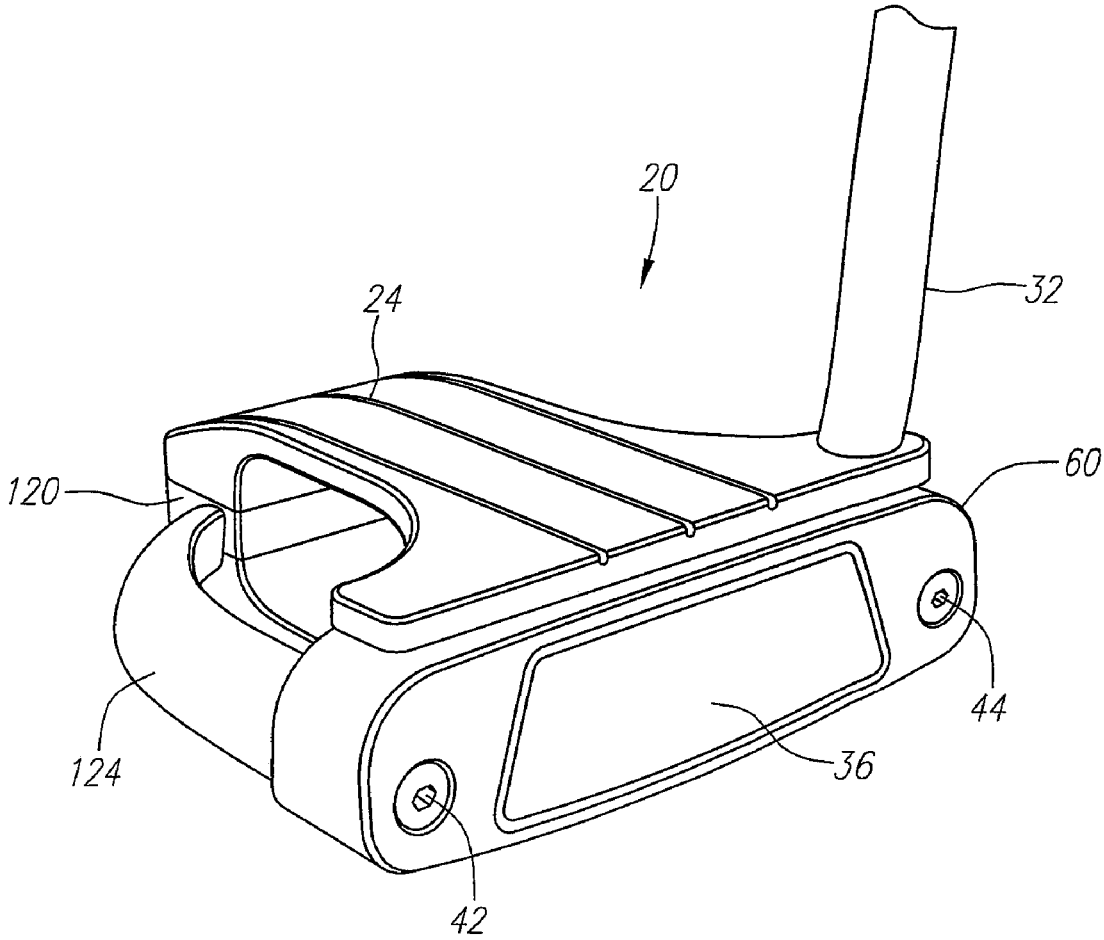
FIG. 5 is a top front perspective view of putter-type club head.
Figure 6:
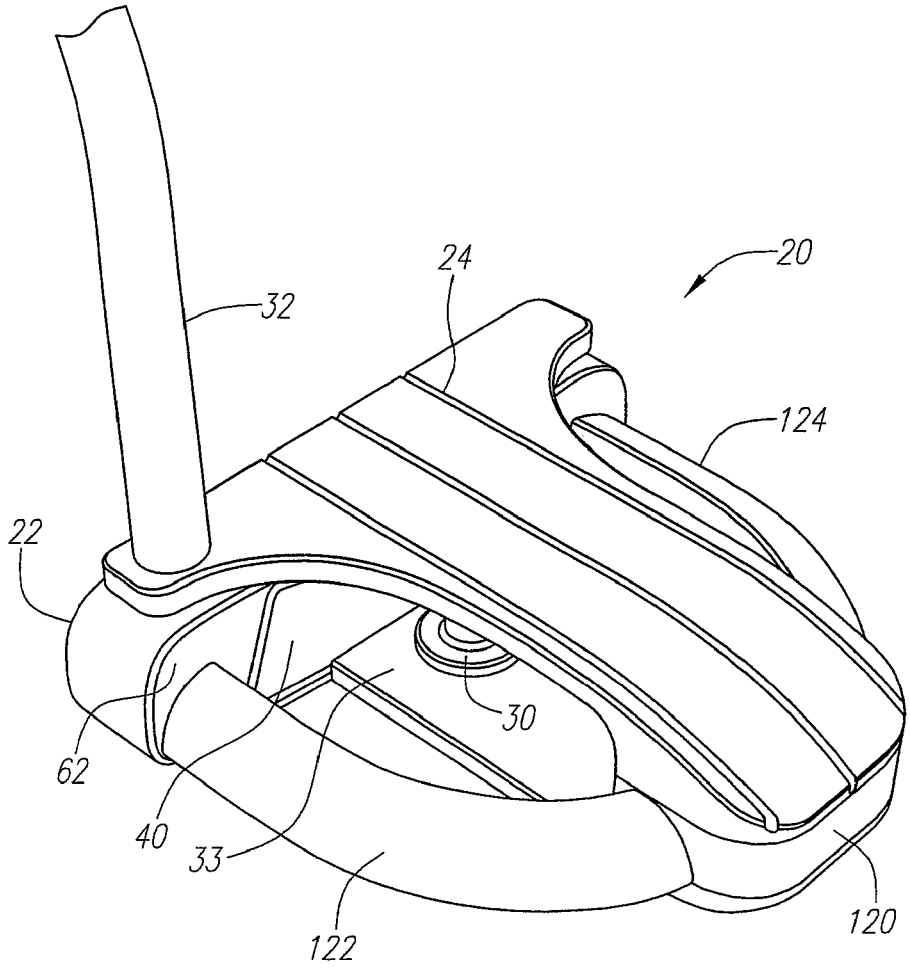
FIG. 6 is a top rear perspective view of a putter-type club head.

As shown in FIGS. 1-8, a putter-type club head of the present invention is generally designated 20. The club head 20 preferably includes a blade member 22, a crown member 24, a sole member 26, a peripheral mass belt 28, and a dampening member 30. In a preferred embodiment, each of the blade member 22, crown member 24 and sole member 26 is composed of a material having a density ranging from 0.90 $g/cm^3$ to 6.0 $g/cm^3$. A preferred material is an aluminum alloy. Alternative materials include aluminum, titanium, titanium alloys, magnesium, magnesium alloys, and the like.

Each of the components is removable and may be interchanged with a substitute component. The blade member 22 has a first face surface 60 with a first recess 34 therein and a second face surface 62 with a second recess 38 therein opposite the first face surface 60. A first insert 36 is disposed within the first recess 34 and a second insert 40 is disposed within the second recess 38.

The blade member 22 with inserts 36 and 40, sole member 26 and crown member 24 combined preferably weigh from 100 grams to 300 grams, more preferably from 150 grams to 275 grams, even more preferably from 200 grams to 250 grams and most preferably 210 grams.

The peripheral mass belt 28 is preferably composed of a material that has a density greater than the density of the material of the blade member 22, crown member 24 or sole member 26. In a preferred embodiment, the peripheral mass belt 28 is composed of a material having a density ranging from 6.0 g/cm$^3$ to 20.0 g/cm$^3$, and more preferably from 7.0 g/cm$^3$ to 10.0 g/cm$^3$. In a preferred embodiment, the peripheral mass belt 28 is composed of stainless steel. In alternative embodiments, the peripheral mass belt 28 is composed of zinc, brass, copper, gold, silver, tungsten, tungsten-based alloys, iron-based alloys, and copper-based alloys.

The peripheral mass belt 28 preferably weighs from 80 grams to 300 grams, more preferably from 90 grams to 200 grams, even more preferably from 100 grams to 180 grams, even more preferably from 120 grams to 135 grams, and most preferably 127 grams.

The club head 20 preferably has a mass ranging from 250 grams to 500 grams, more preferably from 300 grams to 400 grams, and most preferably 340 grams.

The blade member 22, the crown member 24, the sole member 26 and the peripheral mass belt 28 define a central aperture 33. The central aperture 33 has a heel opening 84 at a heel end of the club head 20 and a toe opening 86 at a toe end of the club head 20. The central aperture 33 horizontally separates the blade member 22 from the peripheral mass belt 28, and the central aperture 33 vertically separates the crown member 24 from the sole member 26. Due to the length of the crown member 24, the club head 20 preferably has a dampening member 30 within the central aperture 33. The dampening member 30 also dampens the vibrations through the club head 20 during impact with a golf ball. The central aperture 33, in connection with the peripheral mass belt 28, allows for the center of gravity of the club head 20, "CG", to be moved rearward from the blade member 22.

In a preferred embodiment, the CG of the club head 20 is positioned within the central aperture 33, and thus the CG is not positioned within material of the club head 20 but instead the CG lies outside the material in space within the central aperture 33. Preferably, the CG is located between 0.25 inch and 1.0 inch from an external surface of the sole member 26, more preferably 0.50 inch to 0.75 inch, and most preferably 0.73 inch from the external surface of the sole member 26. Also, preferably the CG of the club head 20 is located 1.50 inches to 3.5 inches rearward from the striking surface of the blade member 22, more preferably 2.0 inches to 3.0 inches, and most preferably 2.85 inches from the striking surface of the blade member 22.

In addition to assisting in the rearward positioning of the CG, the peripheral mass belt 28 is a rearward support structure for crown member 24. The peripheral mass belt 28 preferably ranges from 20 to 50 volume percent of the club head 20 and ranges from 40 to 75 weight percent of the club head 20.

The crown member 24 extends rearward from the blade member 22. The crown member 24 has a central elongated section 96 and a front section 94. The front section 94 has a width W' that extends from the heel end to the toe end of the blade member 22, and gradually narrows as the front section 94 transitions into the central elongated section 96. The width, W', preferably ranges from 3.0 inches to 6.0 inches, more preferably from 4.5 inches to 5.5 inches, and most preferably 5.22 inches. The central elongated section 96 has a width W" that is less than the width w' of the front section 94. The width, W", preferably ranges from 1.0 inch to 3.0 inches, more preferably from 1.5 inches to 2.25 inches, and most preferably 1.8 inches. The internal surface of the crown member 24 partially defines the central aperture 33. The crown member 24 and the sole member 26 each preferably has a thickness that ranges from 0.10 inch to 0.50 inch, more preferably 0.15 inch to 0.30 inch. Further, the sole member 26 may be composed of a higher density material such as stainless steel in order to lower the CG of the club head 20.

The external surface of the crown member 24 preferably has an alignment means 100 thereon. The external surface also preferably has an aperture for placement of a shaft or hosel 32, therein.

A preferred alignment means 100 is first circular insert 104*a* and second circular insert 104*b* disposed within recesses in the crown member 24. The depth of each of the recesses is preferably within 0.05 inch to 0.50 inch, more preferably 0.1 inch to 0.250 inch. Each of the circular inserts 104*a-b* preferably has a thickness ranging from 0.05 inch to 0.50 inch, more preferably 0.1 inch to 0.250 inch.

In a preferred embodiment, each of the circular inserts 104*a-b* is preferably composed of a thermosetting polyurethane material such as described in U.S. Pat. No. 6,273,831, entitled Golf Club Head with A Polymer Insert, assigned to Callaway Golf (the assignee of the Present Application), which is hereby incorporated by reference in its entirety. Alternatively, each of the circular inserts 104*a-b* may be composed of a thermoplastic polyurethane. Each of the circular inserts 104*a-b* is preferably colored white, through painting or doping of the polyurethane with coloring agents, and each circular insert 104*a-b* preferably has a texture of a golf ball cover. Each of the circular inserts 104*a-b* preferably has a diameter ranging from 1.62 inches to 1.70 inches, and most preferably 1.68 inches.

Alternative alignment means 100 are disclosed in U.S. Pat. No. 4,688,798, entitled Golf Club And Head Including Alignment Indicators, assigned to the Callaway Golf (the assignee of the Present Application), which pertinent parts are hereby incorporated by reference. As disclosed in U.S. Pat. No. 4,688,798, the alignment means assists a golfer in properly aiming a golf ball toward a hole when putting. Alternative alignment means, including a large white strip may be utilized in the present invention.

The first insert 36 is preferably composed of a polymer material such as disclosed in U.S. Pat. No. 6,238,302, entitled A Golf Club Head With An Insert Having Integral Tabs, assigned to Callaway Golf (the assignee of the Present Application), which is hereby incorporated by reference in its entirety. As disclosed in U.S. Pat. No. 6,238,302, the first insert 36 is preferably composed of a thermosetting polyurethane material and is preferably colored white. The first insert 36 preferably has a Shore D hardness ranging from 30 to 60. The second insert 40 is preferably composed of a metal material such as stainless steel.

The putter-type club head 20 preferably has a length, L, from the blade member 22 to the rearward most end of the peripheral mass belt 28, preferably ranging from 3.0 inches to 6.0 inches, more preferably from 4.5 inches to 5.5 inches, and most preferably 5.07 inches. In one alternative embodiment, the putter-type club head 20 has a length, L, that is equal to the width, W'.

The peripheral mass belt 28 preferably includes a central mass portion 120, a heel arc member 122 and a toe arc member 124. The heel arc member 122 and the toe arc member 124 extend outward from the central mass portion 120 on opposing ends of the central mass portion 120.

The putter-type club head 20 preferably has a moment of inertia about the Izz axis through the center of gravity ranging from 3750 g-cm$^2$ to 4200 g-cm$^2$, and more preferably 3950 g-cm$^2$ to 4100 g-cm$^2$. The Izz axis extends from the sole to the crown.

As shown in FIG. 1, each component is removable and interchangeable. The blade member 22 is attached to the peripheral mass belt 28 through the use of bolts 42 and 44 inserted through apertures 46 and 48 of the blade member and into preferably threaded sockets 50 and 52 of the peripheral mass belt 28. This allows for the face of the blade member 22 to be reversed if a golfer wants to use a different striking surface. Each bolt 42 and 44 preferably has a wrench cavity 70*a* and 70*b* for use of a wrench for attachment and removal. The dampening member 30 is preferably attached to the sole member 26 with a bolt 55. The sole member 26 and the crown member 24 are both preferably attached to the central mass portion 120 of the peripheral mass belt 28 using bolts 56 and 57. The hosel or shaft 32 is preferably attached to the crown member 24 using a bolt 59.

Figure 7:
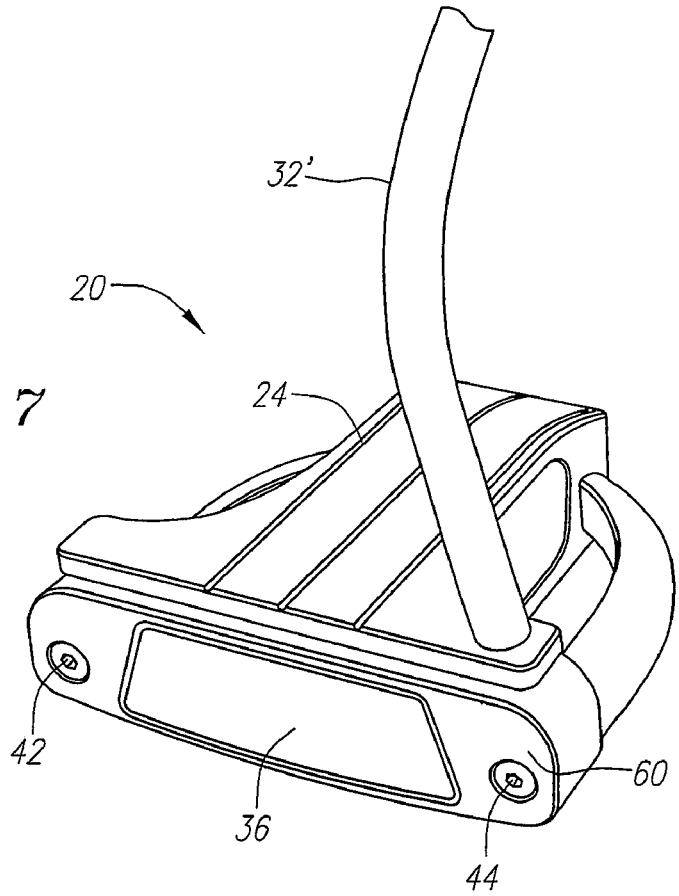
FIG. 7 is a top front perspective view of putter-type club head.
Figure 8:
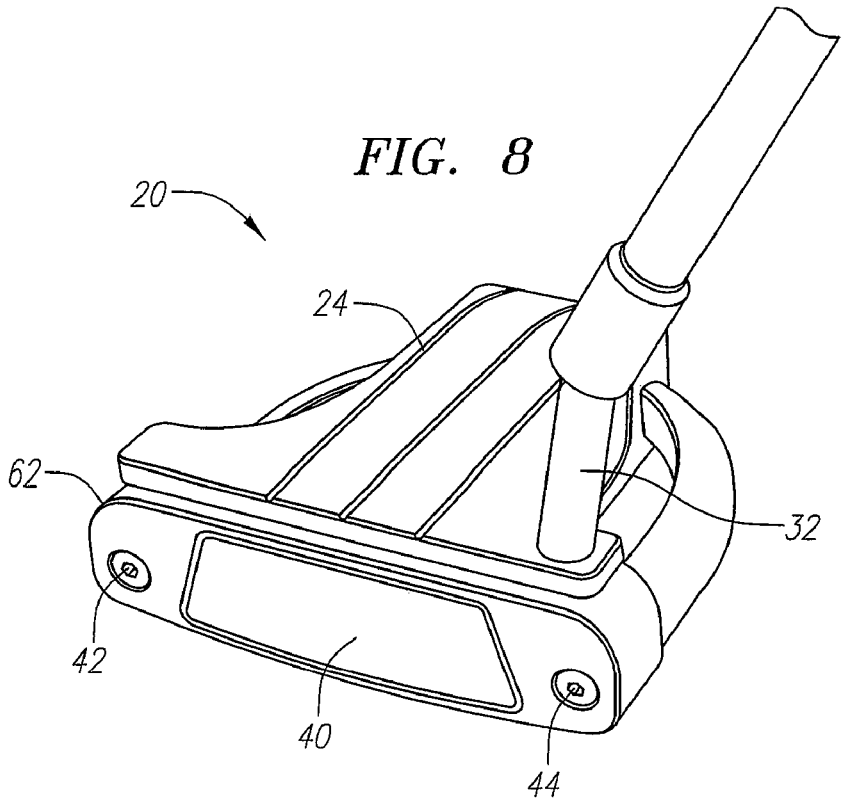
FIG. 8 is a top front perspective view of putter-type club head.

As shown in FIGS. 7 and 8, the striking surface of the blade member 22 may be changed from the first surface 60 with the polymer insert 36 to the second surface 62 with the metal insert 40. Also, the shaft 32' may be directed attached to the crown member 24 as shown in FIG. 7, or a hosel 32 may be attached directly to the crown member 24.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A putter-type club head comprising:

a blade member having a first face surface and a second face surface, the first face surface having a first recess therein, the second face surface having a second recess therein;

a first insert disposed within the first recess, the first insert composed of a polymer material;

a second insert disposed within the second recess, the second recess composed of a metal material;

a peripheral mass belt removably attached to the blade member, the peripheral mass belt having a central mass portion, a heel arc member extending from the central mass portion and a toe arc member extending from the central mass portion;

a crown member disposed above the peripheral mass belt and attached thereto;

a sole member disposed below the peripheral mass belt and attached thereto;

wherein the blade member, the crown member, the sole member and the central mass portion of the peripheral mass belt define a central aperture through the putter-type club head having a heel end opening and a toe end opening, and the central aperture separates the crown member from the sole member, and the blade member from the central mass portion;

wherein the putter-type club head has a length, L, from the first surface of the blade member to the rearward most end of the peripheral mass belt ranging from 3.0 inches to 6.0 inches.

2. The putter-type club head according to claim 1 further comprising a plurality of recesses on an external surface of the crown member, each of the plurality of recesses having a circular shape with a diameter ranging from 1.62 inches to 1.70 inches;

a plurality of circular inserts, each of the plurality of circular inserts disposed within a corresponding recess of the plurality of recesses.

3. The putter-type club head according to claim 2 wherein each of the plurality of circular inserts is composed of a thermosetting polyurethane material, and each of the plurality of circular inserts has a white color.

4. The putter-type club head according to claim 1 wherein the center of gravity of the club head is located from between 0.25 inch to 1.0 inch upward from an external surface of the sole member.

5. The putter-type club head according to claim 4 wherein the center of gravity of the club head is located 1.50 inches to 3.5 inches rearward from the second surface of the blade member.

6. The putter-type club head according to claim 1 further comprising an alignment means disposed on the crown member.

7. The putter-type club head according to claim 1 wherein the first insert is composed of a thermoplastic polyurethane material having a Shore D hardness ranging from 30 to 60.

8. The putter-type club head according to claim 1 wherein the second insert is composed of a stainless steel material.

9. The putter-type club head according to claim 1 further comprising a plurality of bolts for attaching the blade member to the peripheral mass belt.

10. A putter-type club head comprising:

a blade member having a first face surface and a second face surface, the first face surface having a first recess therein, the second face surface having a second recess therein;

a first insert disposed within the first recess, the first insert composed of a polymer material;

a second insert disposed within the second recess, the second recess composed of a metal material;

a peripheral mass belt removably attached to the blade member, the peripheral mass belt having a central mass portion, a heel arc member extending from the central mass portion a toe arc member extending from the central mass portion;

a crown member disposed above the peripheral mass belt and attached thereto;

a sole member disposed below the peripheral mass belt and attached thereto; and a dampening member disposed between the crown member and the sole member, the dampening member disposed within the heel arc member and the toe arc member of the peripheral mass belt.

11. The putter-type club head according to claim 10 wherein the putter-type club head has a length, L, from the face portion to the rearward most end of the peripheral mass belt ranging from 3.0 inches to 6.0 inches.

12. The putter-type club head according to claim 10 wherein the peripheral mass belt ranges from 20 to 50 volume percent of the putter-type club head and ranges from 40 to 60 weight percent of the body.

13. The putter-type club head according to claim 10 wherein the peripheral mass belt is composed of stainless steel.

14. The putter-type club head according to claim 10 wherein the first insert is composed of a thermoplastic polyurethane material having a Shore D hardness ranging from 30 to 60.

15. The putter-type club head according to claim 10 wherein the second insert is composed of a stainless steel material.

16. The putter-type club head according to claim 10 further comprising a plurality of bolts for attaching the blade member to the peripheral mass belt.

17. The putter-type club head according to claim 10 wherein the dampening member is composed of a polymer material.

18. The putter-type club head according to claim 10 wherein the crown member and the sole member are composed of an aluminum material.

19. The putter-type club head according to claim 10 wherein the peripheral mass belt is composed of a material having a density ranging from 7.00 $g/cm^3$ to 10.0 $g/cm^3$.

* * * * *